US007938667B2

(12) United States Patent
Gonzalez et al.

(10) Patent No.: US 7,938,667 B2
(45) Date of Patent: May 10, 2011

(54) CONNECTOR RETAINING BRACKET

(75) Inventors: Adolpho Gonzalez, Fresno, CA (US); Brian Ray, Livermore, CA (US)

(73) Assignee: Juniper Networks, Inc., Sunnyvale, CA (US)

( * ) Notice: Subject to any disclaimer, the term of this patent is extended or adjusted under 35 U.S.C. 154(b) by 0 days.

(21) Appl. No.: 12/491,618

(22) Filed: Jun. 25, 2009

(65) Prior Publication Data

US 2009/0264007 A1 Oct. 22, 2009

Related U.S. Application Data

(63) Continuation of application No. 12/021,838, filed on Jan. 29, 2008, now Pat. No. 7,568,935.

(51) Int. Cl.
*H01R 4/26* (2006.01)

(52) U.S. Cl. ..... 439/345; 439/373; 439/362

(58) Field of Classification Search ..... 439/345, 439/351, 362, 373
See application file for complete search history.

(56) References Cited

U.S. PATENT DOCUMENTS 5,820,412 A 10/1998 Koegel et al.
5,955,703 A 9/1999 Daly et al.

OTHER PUBLICATIONS

A. Gonzalez et al., co-pending U.S. Appl. No. 12/021,838, filed Jan. 29, 2008, entitled "Connector Retaining Bracket".

*Primary Examiner* — Briggitte R Hammond
(74) *Attorney, Agent, or Firm* — Harrity & Harrity, LLP

(57) ABSTRACT

A retainer may include a hollow portion for holding a connector, a path for conveying the connector from outside the retainer to the hollow portion, a surface that is adjacent to the connector when the connector is held in the hollow portion, a fastener for applying a force to couple the retainer to a device, and a member that causes the surface to press the connector against a connector receiver associated with the device and to prevent the connector from being disengaged from the connector receiver.

15 Claims, 5 Drawing Sheets

CONNECTOR RETAINING BRACKET

RELATED APPLICATION

This application is a continuation of U.S. application Ser. No. 12/021,838, filed Jan. 29, 2008, the entire contents of which is incorporated herein by reference.

BACKGROUND

Devices (e.g., computing devices, communication devices, etc.) require various connectors and cables (e.g., communication cable connectors, power cords, etc.) to properly function. However, such connectors and/or cables may become disconnected from devices due to vibrations, earthquakes, accidental removal, etc. This may cause the devices to malfunction. For example, a communication cable or power cord may disconnect from a network device, which may cause the network device to cease transmitting and/or receiving network traffic.

SUMMARY

A retainer may include a hollow portion for holding a connector, a path for conveying the connector from outside the retainer to the hollow portion, a surface that is adjacent to the connector when the connector is held in the hollow portion, a fastener for applying a force to couple the retainer to a device, and a member that causes the surface to press the connector against a connector receiver associated with the device and to prevent the connector from being disengaged from the connector receiver.

BRIEF DESCRIPTION OF THE DRAWINGS

The accompanying drawings, which are incorporated in and constitute a part of this specification, illustrate one or more implementations described herein and, together with the description, explain these implementations. In the drawings.

DETAILED DESCRIPTION

The following detailed description refers to the accompanying drawings. The same reference numbers in different drawings may identify the same or similar elements. Also, the following detailed description does not limit the invention.

Systems and methods described herein may provide a connector retaining bracket to ensure a continued attachment of a connector and/or a cable to a device. In one implementation, the device may include a connector receiver configured to receive the connector, and the connector may connect to the device via the connector receiver.

The connector retaining bracket may include a bracket and fasteners. The bracket may fit around and hold the connector, which is connected to the connector receiver. The fasteners may affix the bracket to the device to which the connector receiver is attached. The tension with which the bracket retains the connector in place may be applied by the fasteners. Consequently, the connector retaining bracket may prevent the connector from disconnecting from the device.

Exemplary System

Figure 1:
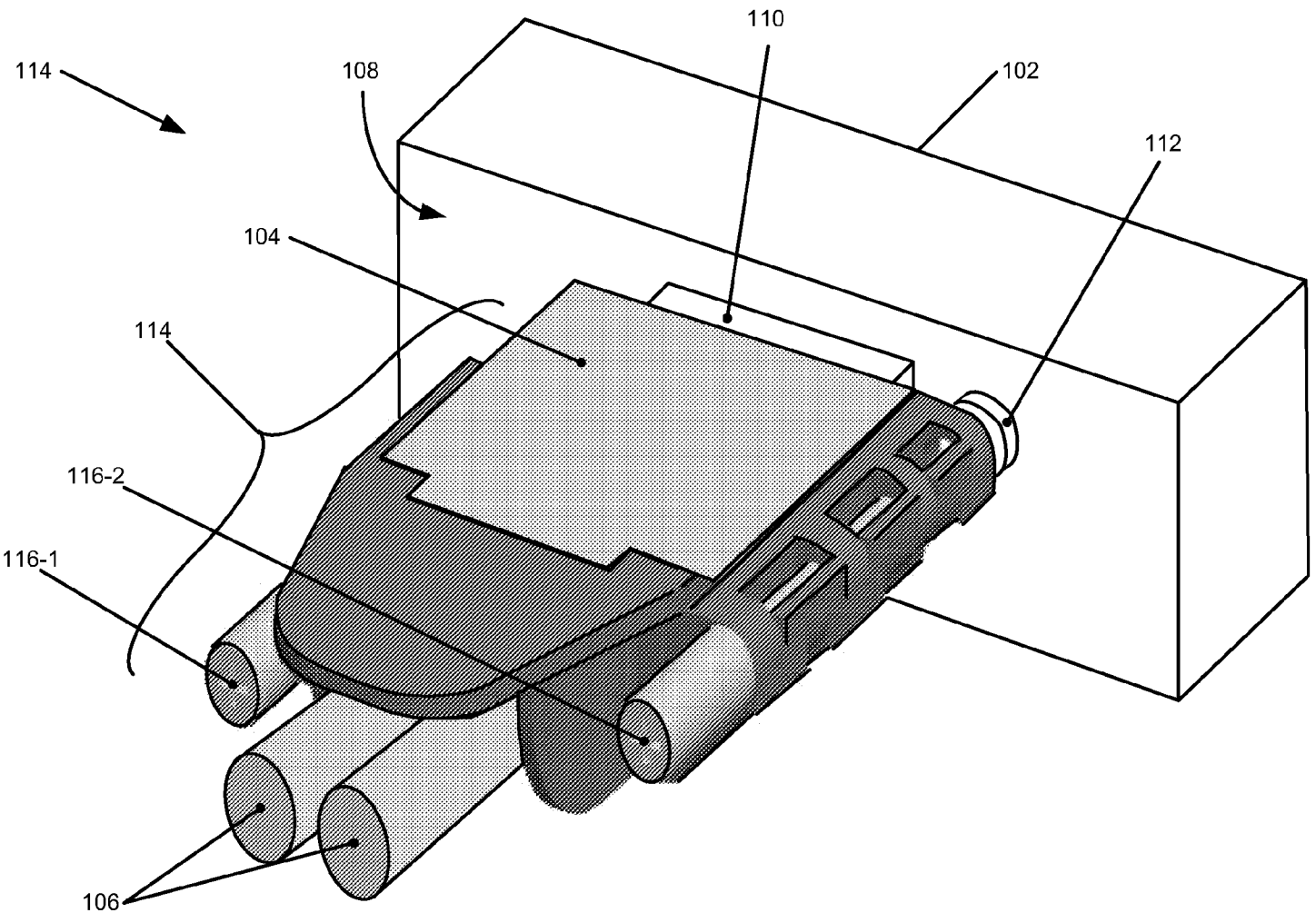
FIG. 1 is a diagram illustrating an isometric view of an exemplary system in which a connector retaining bracket described herein may be implemented.

FIG. 1 is a diagram illustrating an isometric view of an exemplary system 100 in which a connector retaining bracket described herein may be implemented. As illustrated, system 100 may include a device 102 (that includes a panel 108, a connector receiver 110, and fastener supports 112 (only one fastener support is shown)), a connector 104, connector cords 106, a bracket 114, and fasteners 116-1 and 116-2.

Device 102 may include a network device (e.g., a gateway, a router, a switch, a firewall, a network interface card (NIC), a hub, a bridge, a proxy server, or some other type of device that processes and/or transfers data), a computation or communication device (e.g., a laptop, a personal computer, a work station, a server, etc.), a mobile communication device (e.g., e.g., a personal communications system (PCS) terminal, a personal digital assistant (PDA), a cellular telephone, etc.), and/or any other device capable of receiving a connector, such as connector 104. Although device 102 is shown in FIG. 1 as including panel 108, connector receiver 110, and screw supports 112, in other implementations, device 102 may include additional components (not shown) depending upon the function of device 102.

Connector 104 may include a communication cable connector (e.g., peripheral component interface (PCI) express (PCIE) connector, a Universal Serial Bus (USB) connector, etc.), a power cord connector (e.g., a power supply connector, a plug, etc.), an eight position, eight conductors (8P8C or "RJ45") connector, a nine-pin D-shell (DE-9) connector, an optical connector (e.g., a standard connector (SC), a ferrule connector (FC), a sub miniature A (SMA) connector, etc.), a telephone connector, etc.), etc.

Connector cords 106 may include cords connected to connector 104. For example, connector cords 106 may include PCIE cables, a power cord, etc., that may provide electrical signals, optical signals, communication signals, power, etc. to device 102 via connector 104, depending upon the function of connector 104.

Panel 108 may include a surface on device 102 or a portion of the surface to which connector receiver 110 and/or screw supports 112 may be affixed or mounted. Panel 108 may be made of the same material as a housing for device 102 (e.g., sheet metal, plastic, etc.) and may be capable of rigidly supporting connector receiver 110 and/or screw support 112. For example, panel 108 may substantially maintain the flatness of its shape when connector 104 is inserted into connector receiver 110 and thumb screws 116-1 and 116-2 are inserted into screw holes in screw supports 112 and tightened.

Connector receiver 110 may include a mechanism that is sized, shaped, and/or configured to receive connector 102. For example, if connector 110 is a male PCIE connector, connector receiver 110 may be sized and shaped to receive the size and shape of the PCIE connector, and may include a socket to receive pins for a ground, a positive connection (e.g., +12 volt), a negative connection that may connect with a corresponding ground, a clock, data, etc. Connector receiver 110 may attach connector 104 to internal components of device 102, and may enable connector 104 to communicate (e.g., electrically communicate, optically communicate, etc.) with device 102. Depending on the implementation, connector receiver 110 may accommodate connectors of different dimensions and configurations (e.g., an 18-pin male/female PCIE connector, 32-pin male/female PCIE connector, etc.).

Fastener supports 112 may include a component that is mounted and/or affixed to panel 108 and may provide a feature to which fasteners 116-1 and 116-2 may latch or be attached to. In one implementation, fastener supports 112 may be implemented as screw supports. In such an implementation, the flat surface on fastener supports 112 may include a threaded screw hole (not shown) through which a thumb screw may be inserted via a portion of bracket 114. Once the thumb screws are inserted and tightened, bracket 114 may be coupled rigidly and stably against device 102. In a different implementation, fastener supports 112 may include latches to which springs attached to the bracket may be locked/fastened. Locking the springs may couple the bracket 114 rigidly and stably against device 102. While many different mechanisms may be used to provide the functionalities of fastener supports 112, however, in the following descriptions, fastener supports 112 will be described in terms of screw supports.

Bracket 114 may receive connector 104 and apply a force on connector 104 against connector receiver 110 to ensure that connector 104 remains connected to connector receiver 110 of device 102. In one implementation, bracket 114 may resemble a rectangular plastic box that includes a cavity for receiving connector 104 and connector cords 106. Bracket 114 may be implemented in a variety of shapes and sizes depending upon the size and shape of connector 104. For example, in one implementation, bracket 114 may be small in size if connector 104 is small (e.g., a telephone connector), and may be large in size if connector 104 is large (e.g., a power cord connector).

Bracket 114 may be made from a variety of materials, such as a thermoplastic polymer (e.g., a polycarbonate resin, polyethylene, polypropylene, polyvinyl chloride, a fluoroplastic, etc.), a metal or metal alloy (e.g., stainless steel, copper, iron, nickel, zinc, brass, bronze, aluminum, etc.), a combination of the aforementioned materials, etc. Further details of bracket 114 are provided below in connection with FIGS. 2A through 2D.

Each of fasteners 116-1 and 116-2 may be attached to their respective fastener supports 112 to affix bracket 114 against device 102. In one implementation, each of fasteners 116-1 and 116-2 may be implemented as thumb screws. In such an implementation, each of the thumb screws through a cylindrical tube portion of bracket 114 and into a screw hole in screw supports 112. By rotating each of the thumb screws, the cylindrical portion of bracket 114 and/or connector 104 may be forcibly abutted against edges of connector receiver 110 and/or fastener support 112, preventing connector 104 from becoming loose. In another implementation, wire springs may be used in place of the thumb screws. In such a case, latching the springs to fastener support 112 may apply the necessary force on bracket 114 to prevent connector 104 from becoming detached from connector receiver 110. While many different mechanisms can be used to apply the force on bracket 114 in different implementations, however, in the following, fasteners 116-1 and 116 will be described in terms of thumb screws.

Although FIG. 1 shows exemplary components of system 100, in other implementations, system 100 may contain fewer, different, or additional components than depicted in FIG. 1. In still other implementations, one or more components of system 100 may perform one or more of the functions described as performed by one or more other components of system 100.

Exemplary Connector Retaining Bracket Configuration

FIGS. 2A through 2D are isometric, top, front, and side views, respectively, of bracket 114 that uses thumb screws as fasteners 116-1 and 116-2. As illustrated in FIGS. 2A-2D, bracket 114 may include a left wall portion 202-1, a right wall portion 202-2, a bottom wall portion 204, a guard panel portion 206, a left cylindrical tube portion 208-1, a right cylindrical tube portion 208-2, a left fin portion 210-1, a right fin portion 210-2, a left front wall portion 212-1, and a right front wall portion 212-2. In one implementation, the portions may be integrally formed together (e.g., via molding, extrusion, casting, etc.). In another implementation, the portions may be connected together via a variety of connection mechanisms (e.g., via adhesives, glue, solder, screws, and/or similar connection mechanisms). In yet another implementation, guard panel portion 206, left fin portion 210-1, and right fin portion 210-2 of bracket 114 may, or may not, include uniform thickness. In one example, guard panel portion 206 may include a portion whose thickness ranges from about 0.2 millimeter to about 1.5 millimeter.

Left wall portion 202-1, bottom wall portion 204, left front wall portion 210-1, right front wall portion 210-2, and right wall portion 202-2 may be adjoined to form a cavity 214. Left wall portion 202-1 may be adjoined perpendicularly to left front wall portion 210-1 and bottom wall portion 204, and right wall portion 202-2 may be adjoined perpendicularly to right front wall portion 210-2 and bottom wall portion 204.

The lengths of the adjoined wall portions may be set such that connector 104 may substantially fit snugly into cavity 214, as illustrated in FIG. 1. Depending on the implementation, the dimensions of left wall portion 202-1, bottom wall portion 204, left front wall portion 210-1, right front wall portion 210-2, and right wall portion 202-2 may be designed to fit the shape of a particular type of connector. For example, in one implementation, length X (FIG. 2B), width Y (FIG. 2B), and height Z may be set to about 60 millimeters, 59 millimeters, and 8 millimeters, respectively, so that the wall portions may form a cavity into which a PCIE connector may fit.

In forming cavity 214, left wall portion 202-1, right wall portion 202-2, and bottom wall portion 204 may be cut and shaped to increase the maneuverability of connector 104 when connector is being fitted into or is being removed from cavity 214 of bracket 114.

Figure 2A:
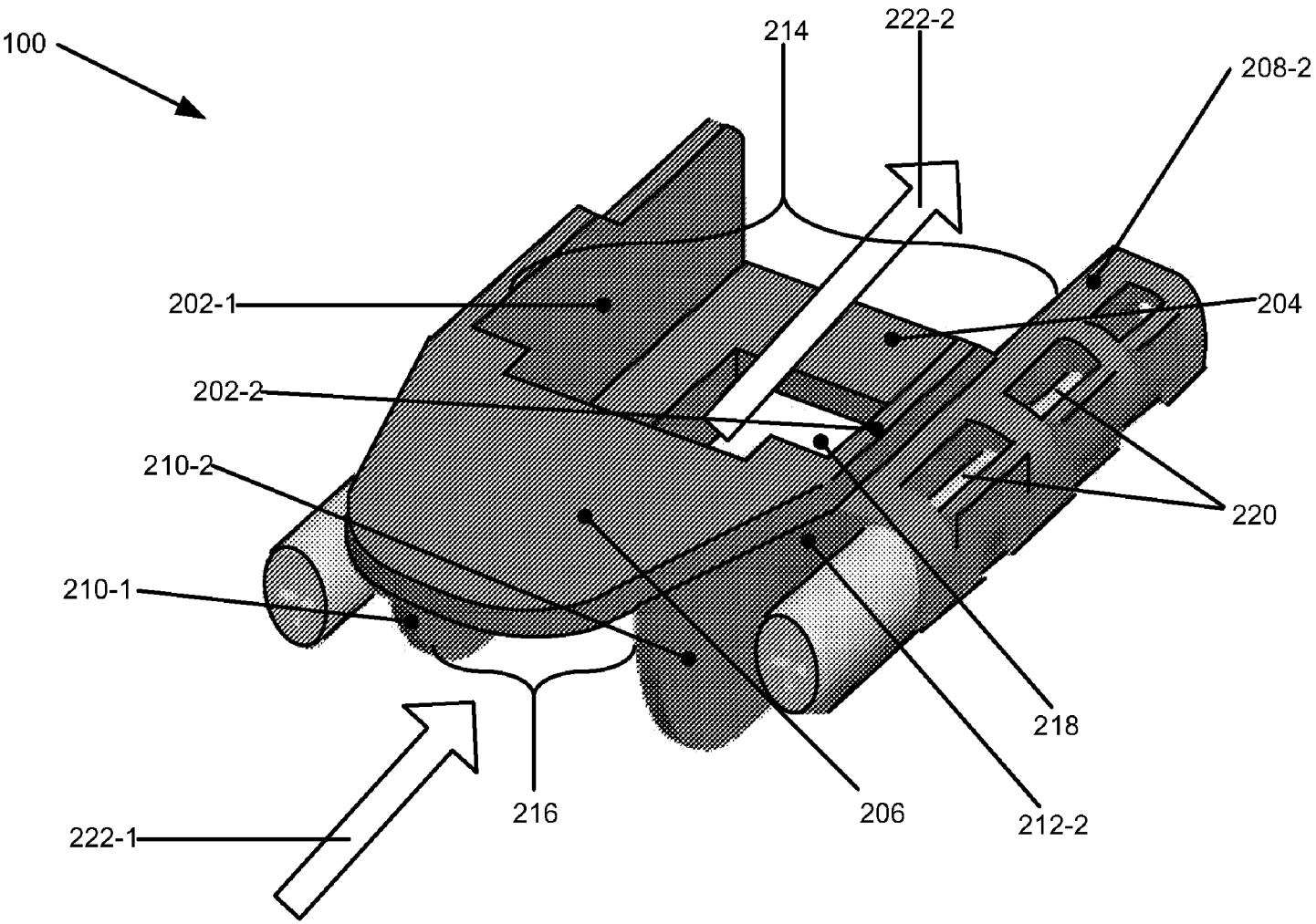
FIG. 2A-2D are isometric, top, front, and side views, respectively, of the bracket illustrated in FIG. 1.
Figure 2B:
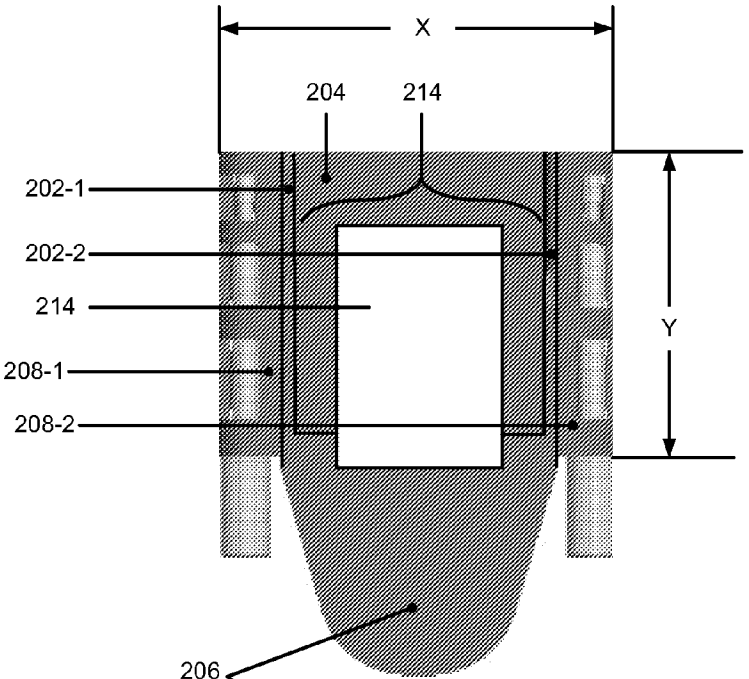
Figure 2C:
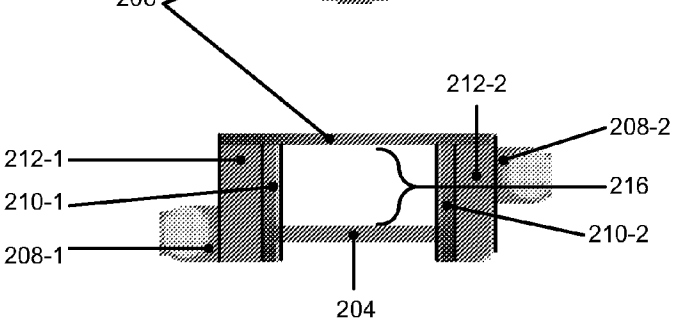

For example, bottom wall portion 204, as shown in FIGS. 2A and 2B, may include a rectangular slot 218. To fit connector 104 into cavity 214, connector 104 may be inserted through open space 216 in the direction of arrow 222-1 and through cavity 214 in the direction of arrow 222-2. In inserting connector 104 through open space 216, because the width of open space 216 may be shorter than the width of connector 104, connector 104 may be oriented such that a narrow side of connector 104 may face the same direction as guard panel portion 206. To further move connector 104 through open space 216 and into cavity 214, rectangular slot 218 may be formed on bottom wall portion 204. Via rectangular slot 218, connector 104 may easily move through open space 216 and cavity 214.

Figure 2D:
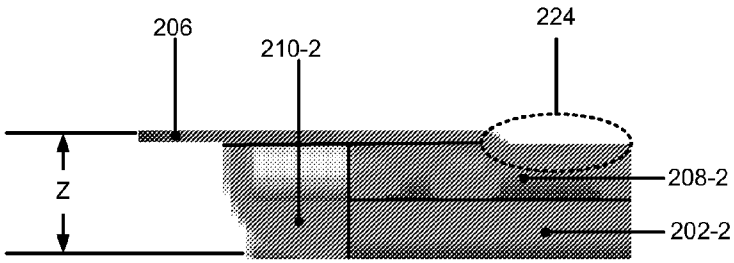

In another example, as shown in FIG. 2D, the top edge of right wall 202-2 may be cut, as shown by a dotted ellipse 224. In removing bracket 114 from connector 104, connector 104 may be easily separated from bracket 114 if connector 104 can be held apart from bracket 114. To facilitate such an action, part of right wall portion 202-1 and left wall portion 202-2 may be cut and removed. As indicated by dotted ellipse 224 in FIG. 2D, a portion of right wall 202-2 may be removed, so that when connector 104 is fitted into cavity 214 in bracket 114, part of connector 104 may be accessible, as the obstructing wall portion has been removed.

When connector 104 is being fitted into cavity 214, once connector 104 has been initially pushed through open space 216 and placed around cavity 214 in the direction of arrow 222-2, connector 104 may be rotated and/or realigned, such that the side flat surfaces of connector 104 are substantially parallel to left side wall portion 202-1, right side wall portion 202-2, and bottom wall portion 204. Once connector 104 is in the proper orientation, connector 104 may be fitted or snapped into cavity 214.

Guard panel portion 206 may be perpendicularly adjoined to the top edge of left wall portion 202-1, right wall portion 202-2, left front wall portion 212-1, and right front wall portion 212-2. In addition, guard panel portion 206 may be cut or shaped to expose a top surface of connector 104 that is placed in cavity 214. In such instances, connector 104 may be easily placed in or removed from cavity 214.

In addition, guard panel portion 206 may include a portion that may extend over cords 106 when connector 104 is fitted into cavity 214. By the virtue of the extension, panel portion 206 may deflect a blow or an impact to cord 106. Without guard panel portion 206, such a blow or an impact may damage or cause connector 104 and/or cord 106 to be separated from one another and/or connector receiver 110.

Left cylindrical tube portion 208-1 and right cylindrical tube portion 208-2 may be adjoined lengthwise to left wall portion 202-1 and right wall portion 202-2, respectively. Furthermore, each of left cylindrical tube portion 208-1 and right cylindrical tube portion 208-2 may be hollow, such that fasteners 116-1 and 116-2 may be inserted into and through left cylindrical tube portion 208-1 and right cylindrical tube portion 208-2. As shown in FIG. 1, if bracket 114 is placed against panel 108 such that connector 104 is inserted into connector receiver 110 and holes in left and right cylindrical tube portions 208-1 and 208-2 are aligned against screw holes in fastener supports 212, fasteners 116-1 and 116-2 (e.g., thumb screws) through left and right cylindrical tube portions 208-1 and 208-2 may be inserted into screw holes in fastener supports 112 and rotated to press connector 104 against connector receiver 110.

Being made of the rigid material, when fasteners 116-1 and 116-2 are tightened, the heads of fasteners 116-1 and 116-2 (e.g., heads of thumb screws) may press against left cylindrical tube portion 208-1 and right cylindrical tube portion 208-2. Left cylindrical tube portion 208-1 and right cylindrical tube portion 208-2 may impart a resulting force to left wall portion 202-1 and right wall portion 202-2, which consequently may distribute the force to other portions of bracket 114. Consequently, left and right front wall portions 212 may push connector 104 in cavity 214 against connector receiver 110, to prevent connector 104 from becoming separated or unplugged from connector receiver 110.

Depending on the implementation, left and right cylinder tube portions 208-1 and 208-2 may include slots 220 that render portions of thumb screws 116-1 and 116-2 visible when thumb screws are placed in left and right cylinder tube portions 208-1 and 208-2. In such cases, if one or both of thumb screws 116-1 and 116-2 break, the breaks may be visible through slots 220. A user that sees the damages may take corrective actions.

Left fin portion 210-1 and right fin portion 210-2 may be adjoined to top edges of left front wall portion 212-1 and right front wall portion 212-2. Left fin portion 210-1 and right fin portion 210-2 may be sized and positioned perpendicularly underneath guard panel portion 206 such that guard panel portion 206, left fin portion 210-1, and right fin portion 210-2 may provide for enough open space 216 to accommodate cords 216 attached to connector 104 when connector 104 is fitted into cavity 214. In addition, left fin portion 210-1 and right fin portion 210-2 may extend from left front wall portion 212-1 and right wall portion 212-2 to protect cord 106 from inadvertent touches, impact, blows, etc. in lateral directions.

Although FIGS. 2A through 2D show exemplary portions of bracket 114, in other implementations, bracket may contain fewer, different, or additional components than depicted in FIGS. 2A-2D. For example, in implementations that use wire springs to fasten bracket 114 to device 102, bracket 114 may not include left and right cylindrical tube portions 208-1 and 208-2. In still other implementations, one or more portions of bracket 114 may perform one or more of the functions described as being performed by one or more other portions of bracket 114.

Exemplary Fasteners

Figure 3:
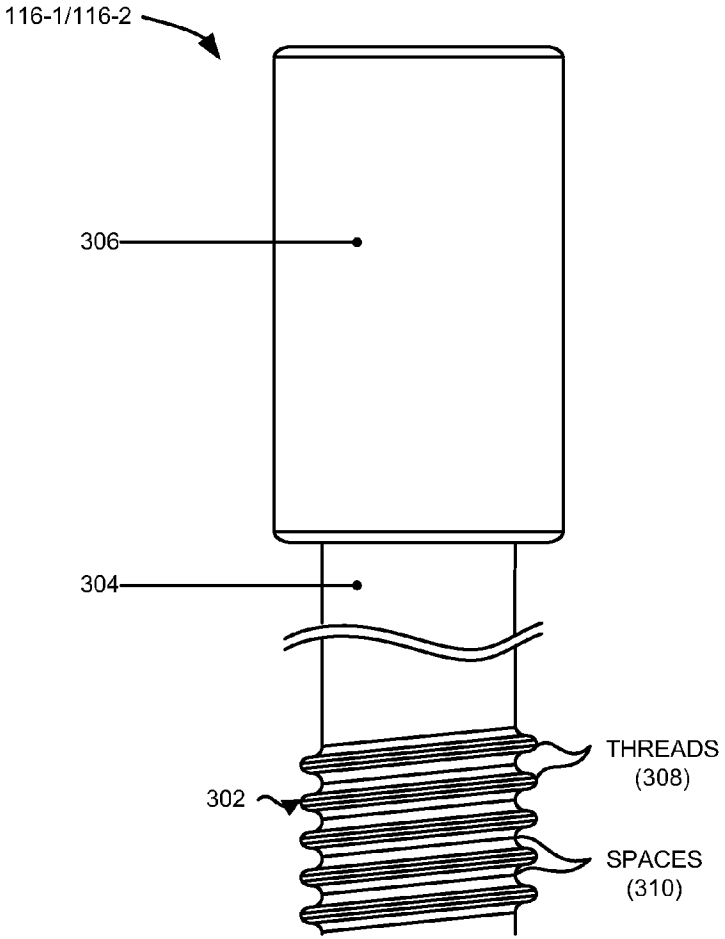
FIG. 3 is a side view of a thumb screw illustrated in FIG. 1.

FIG. 3 is a side view of fastener 116-1/116-2 that is implemented as a thumb screw. As illustrated in FIG. 3, fastener 116-1/116-2 may include a threaded portion 302, a beam portion 304, and a head portion 306. Depending on implementation, fastener 116-1/116-2 may include additional or different portions than those illustrated in FIG. 3.

Threaded portion 302 of fastener 116-1/116-2 may include threads 308 and spaces 310. One or more threads 308 may be provided in threaded portion 302, and one space 310 may be provided between adjacent threads 308. Threads 308 and spaces 310 may be configured similar to threads and spaces provided on a bolt or a screw. For example, threads 308 and spaces 310 may be provided in a helical configuration as either right-handed threads or left-handed threads.

Beam portion 304 may include a cylindrical portion that connects threaded portion 302 to head portion 306.

Head portion 306 of fastener 116-1/116-2 may include a portion that is configured to have a diameter larger than that of beam portion 304 and may be sized to enable a user to manipulate (e.g., rotate clockwise or counter-clockwise) fastener 116-1/116-2 with one or more digits (e.g., a thumb and a finger) of the user's hand.

In some implementations, head portion 306 may include one or more grooves that may be formed on a peripheral surface of head portion 306, and may sized to enable a user to manipulate (e.g., rotate clockwise or counter-clockwise) fastener 116-1/116-2 with one or more digits (e.g., a thumb and a finger) of the user's hand. Such grooves may provide traction for the user's grip and permit the user to turn fastener 116-1/116-2 with forces applied by the thumb and the finger. Although not shown in FIG. 3, in other implementations, head portion 306 may include one or more slots that form a drive design (e.g., a flathead, a Phillips head, a hex design, etc.). The drive design may be manipulated by a corresponding mechanism (e.g., a flathead screwdriver, a Phillips head screwdriver, an Allen wrench, etc.) so that a user may manipulate (e.g., rotate clockwise or counter-clockwise) fastener 116-1/116-2.

In operation, threaded portion 302 and beam portion 304 may be inserted through a hole in cylindrical tube portion 208-1 of bracket 114 while connector 104 is placed in cavity 214. In such a configuration, threaded portion 302 may be aligned with one of fastener supports 112. When head portion 306 of fastener 116-1/116-2 is turned, a forced applied by a user to turn fastener 116-1/116-2 may cause head portion 306 of fastener 116-1/116-2 to move toward fastener support 112.

This may increase a force applied by bracket 114 on connector 104. Turning fastener 116-1/116-2 (with right-handed threads) counter-clockwise may cause head portion 306 of fastener 116-1/116-2 to move away from screw support 112 and may cause bracket 114 to move away from connector receiver 110 and/or fastener support 112. This may decrease a force applied by bracket 114 on connector 104. If threads 308 are left-handed threads, the reverse of the above example may occur.

Although FIG. 3 shows exemplary components of fastener 116-1/116-2 when fastener 116-1/116-2 is implemented as a thumb screw, fastener 116-1/116-2 in other implementations may contain fewer, different, or additional components than depicted in FIG. 3. In still other implementations, one or more portions of fastener 116-1/116-2 may perform one or more of the functions described as being performed by one or more other portions of fastener 116-1/116-2.

Exemplary Process

Figure 4:
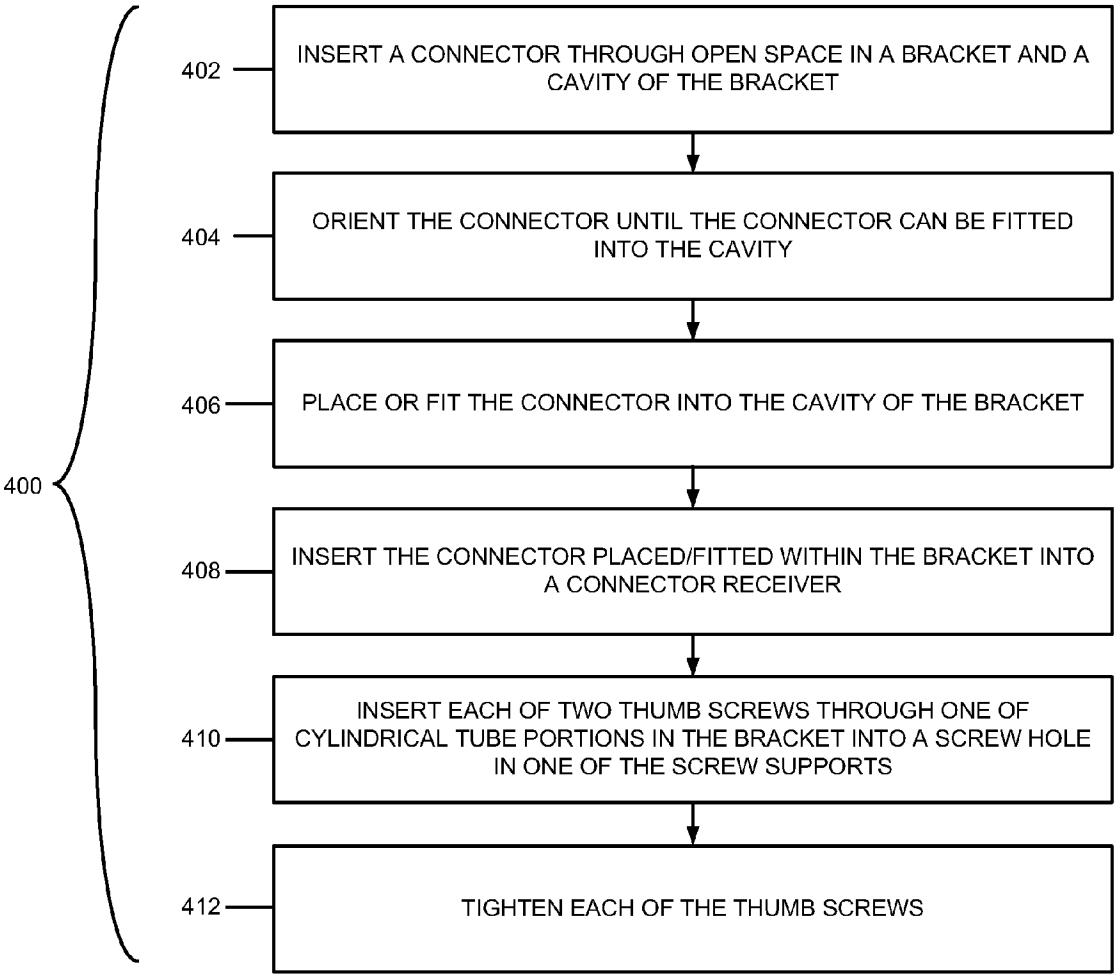
FIG. 4 is a flowchart of an exemplary process for applying a connector retaining bracket according to implementations described herein.

FIG. 4 depicts a flowchart of an exemplary process 400 according to implementations described herein. As shown in FIG. 4, process 400 may begin with insertion of connector 104 through open space 216 and cavity 214 of bracket 114 (block 402). As described above, inserting connector 104 through open space 216 that is formed by left fin portion 210-1, right fin portion 210-2 and guard panel 206 may entail turning or rotating connector 104 until connector 104 can move through rectangular slot 218 on bottom wall portion 204 of bracket 114. Because a cord may be attached to connector 104, moving connector 104 through open space 214 and cavity 214 may also move the cord through open space 214 and cavity 216.

Connector 104 may be oriented such that connector 104 can be snapped into cavity 214 (block 404). Connector 104 may be placed or fitted into cavity 214 (block 406). A user may place connector 104 in cavity 214 until a rear surface of connector 104 presses against left and right front walls 212-1 and 212-2 of bracket 114.

Connector 104 that is placed/fitted within bracket 114 may be inserted into connector receiver 114 (block 408). In one implementation, connector 104 may include female/male connector portion that may be plugged into male/female connector receiver 110.

Each of two fasteners 116-1 and 116-2 may be inserted through part of bracket 114 to be attached to a fastener support (block 410). In one implementation, two fasteners 116-1 and 116-2 may include thumb screws, and each of the thumb screws may be inserted through a corresponding one of cylindrical tube portions 208-1 and 208-2 into a screw hole in one of fastener supports (block 410).

At block 412, each of fasteners 116-1 and 116-2 may be tightened (block 412). As described above, if fasteners are implemented as thumb screws, turning each of fasteners 116-1 and 116-2 may increase the force exerted on connector 104 against connector receiver 110 and/or the force exerted by bracket 114 against screw supports 112.

CONCLUSION

The above describes a connector retaining bracket that may render a connector which may be easily detached from a connector receiver capable of being securely connected to the device. However, the foregoing description provides illustration and description, but is not intended to be exhaustive or to limit the embodiments to the precise form disclosed. Modifications and variations are possible in light of the above teachings or may be acquired from practice of the invention.

For example, while a series of blocks has been described with regard to the flowcharts of FIG. 4, the order of the blocks may differ in other implementations. Further, non-dependent blocks may be performed in parallel.

Even though particular combinations of features are recited in the claims and/or disclosed in the specification, these combinations are not intended to limit the invention. In fact, many of these features may be combined in ways not specifically recited in the claims and/or disclosed in the specification.

No element, act, or instruction used in the present application should be construed as critical or essential to the invention unless explicitly described as such. Also, as used herein, the article "a" is intended to include one or more items. Where only one item is intended, the term "one" or similar language is used. Further, the phrase "based on" is intended to mean "based, at least in part, on" unless explicitly stated otherwise.

What is claimed is:

1. A device comprising:

a bracket that includes:

a plurality of bracket walls to form a cavity to receive a connector, a guard panel attached to one of the plurality of bracket walls, and fins attached to one of the plurality of bracket walls, where the fins and guard panel cover a portion of a cord associated with the connector and define an opening, in the bracket, to insert the connector into the cavity; and a fastener, attached to at least one of the plurality of bracket walls, to releasably couple, via in the bracket, the connector to a receiving device.

2. The device of claim 1, where the opening enables the connector to be inserted into the cavity when the connector is in a first orientation, and where the opening prevents the connector, inserted into the cavity, from being removed from the cavity when the connector is in a second orientation.

3. The device of claim 1, where the opening is further defined by a slot in two or more of the plurality of bracket walls.

4. The device of claim 1, where the connector includes at least one of a power cable connector, a peripheral component interconnect express connector, a universal serial bus connector, or an eight position, eight conductors connector.

5. The device of claim 1, where the device is formed from a material comprising at least one of:

glass;

polycarbonate;

a metal; or a metal alloy.

6. The device of claim 1, where the plurality of bracket walls includes:

a right side wall;

a left side wall;

an upper wall; and a bottom wall.

7. The device of claim 6, where the upper wall is substantially coplanar with an upper surface of the connector when the connector is received by the cavity.

8. The device of claim 6, where the upper wall includes the guard panel.

9. The device of claim 6, where the fastener includes a first fastener coupled to the right side wall and a second fastener coupled to the left side wall.

10. The device of claim 6, where the bottom wall includes a slot to:

enable a connector to be inserted into the cavity when the connector is in a first orientation, and prevent the connector, inserted into the cavity, from being removed from the cavity when the connector is in a second orientation that differs from the first orientation.

11. The device of claim 1, where the plurality of bracket walls includes at least one abutting wall to abut the connector when the connector is received by the cavity;

where the at least one abutting wall comprises a front wall, positioned opposite of the receiving device, when the connector is coupled to the receiving device.

12. The device of claim 11, where the cord, attached to the connector, extends through the opening when the connector is received by the cavity.

13. The device of claim 1, further comprising:

a cylindrical tube integrally connected to the one of the plurality of bracket walls, where the cylindrical tube is to receive the fastener; and where the fastener comprises a thumb screw inserted through the cylindrical tube and into the receiving device.

14. The device of claim 13, where a head portion of the thumb screw includes grooves that are parallel to a cylindrical axis of the thumb screw.

15. The device of claim 13, where the thumb screw includes:

one or more slots on a top surface of the thumb screw to permit at least one of a Phillips screw driver, a flat paneled screw driver, or an Allen wrench to rotate the thumb screw relative to the cylindrical tube.

* * * * *